US009022523B2

(12) United States Patent
Shima

(10) Patent No.: US 9,022,523 B2
(45) Date of Patent: May 5, 2015

(54) INKJET RECORDING APPARATUS HAVING A FIRST AND SECOND COVER

(75) Inventor: Takeaki Shima, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 105 days.

(21) Appl. No.: 13/220,262

(22) Filed: Aug. 29, 2011

(65) Prior Publication Data

US 2012/0050397 A1 Mar. 1, 2012

(30) Foreign Application Priority Data

Aug. 31, 2010 (JP) ..... 2010-193584

(51) Int. Cl.
*B41J 2/165* (2006.01)

(52) U.S. Cl.
CPC ..... *B41J 2/16538* (2013.01)

(58) Field of Classification Search
USPC ..... 347/33, 22, 24, 28, 32, 29
See application file for complete search history.

(56) References Cited

U.S. PATENT DOCUMENTS

| | | | | |
|---|---|---|---|---|
| 6,203,135 | B1 * | 3/2001 | Murcia et al. | 347/22 |
| 6,637,855 | B2 * | 10/2003 | Ide et al. | 347/23 |
| 6,789,876 | B2 * | 9/2004 | Barclay et al. | 347/37 |
| 8,186,804 | B2 * | 5/2012 | Muraoka | 347/33 |
| 2007/0008385 | A1 * | 1/2007 | Akahane | 347/65 |
| 2009/0046123 | A1 * | 2/2009 | Muraoka | 347/33 |
| 2009/0153615 | A1 * | 6/2009 | Chikamoto et al. | 347/33 |

FOREIGN PATENT DOCUMENTS

| | | | |
|---|---|---|---|
| JP | 2000-343717 | A | 12/2000 |
| JP | 2001-030508 | A | 2/2001 |
| JP | 2003-191483 | A | 7/2003 |
| JP | 2006-051806 | A | 2/2006 |
| JP | 2007-296709 | A | 11/2007 |

* cited by examiner

*Primary Examiner* — Henok Legesse
(74) *Attorney, Agent, or Firm* — Canon USA Inc IP Division

(57) ABSTRACT

Among a plurality of recording heads in a non-recording area, a leading end of a second recording head closer to a recording area is situated further forward than the that of another recording head, and a second cover which is provided in a position close to the leading end of the second recording head houses a second cleaning unit which is in contact with the second recording head.

3 Claims, 9 Drawing Sheets

INKJET RECORDING APPARATUS HAVING A FIRST AND SECOND COVER

BACKGROUND OF THE INVENTION

1. Field of the Invention

The present invention relates to an inkjet recording apparatus provided with a maintenance mechanism for cleaning a recording head.

2. Description of the Related Art

Serial inkjet recording apparatuses and linear inkjet recording apparatus have been proposed both of which eject ink from a recording head onto a recording medium which is being conveyed. In a serial inkjet recording apparatus, recording of each line is performed while carriage on which a recording head is mounted reciprocates in a main scanning direction which intersects with the conveyance direction in which the recording medium is conveyed. In a linear inkjet recording apparatus, a recording head with an elongated printing width collectively performs recording of each line. These inkjet recording apparatuses require a maintenance mechanism for removing ink and dust particles adhering near a nozzle of the recording head.

Such a maintenance mechanism is typically provided with a sheet-shaped wiper blade made of, for example, rubber. The wiper blade is moved, while in contact with the nozzle, to scrape the ink and dust particles off. The wiper blade is bent when it is in contact with the nozzle; and then, after passing over the nozzle, the wiper blade returns to its original shape in a single motion. At this time, it is concerned that the ink adhering to the wiper blade scatters toward the recording medium and contaminates the same. Japanese Patent Laid-Open No. 2001-30508 discloses an inkjet recording apparatus with reduced amount of scattering of ink during the wiping operation of the ink adhering to a recording head.

The inkjet recording apparatus disclosed in Japanese Patent Laid-Open No. 2001-30508 is a linear inkjet recording apparatus and is provided with a maintenance mechanism situated between the recording head and the recording medium. This maintenance mechanism is provided with a plurality of scatter prevention walls situated near each of a plurality of recording heads arranged along the width direction of the recording medium. The scatter prevention walls absorb the ink scattering during the wiping operation of wiper blades (elastic blades) so as to minimize the scattering amount of ink. In recent serial inkjet recording apparatuses, it has been proposed that a plurality of recording heads are arranged out of alignment with one another in the conveyance direction (sub-scanning direction) in which the recording medium is conveyed, in order to increase a printing width for each printing event to thereby achieve high speed recording. If the scatter prevention walls disclosed in Japanese Patent Laid-Open No. 2001-30508 are provided in the thus-structured inkjet recording apparatus, the recording heads (carriage) come in contact with the scatter prevention walls during a reciprocation movement in the main scanning direction, which interferes the recording operation. This is because the scattering prevention walls extends to a position higher than nozzle surfaces (i.e., bottom surfaces) of the recording heads and each of the scattering prevention walls is situated close to each of the recording heads in the main scanning direction. This means that the maintenance mechanism disclosed in Japanese Patent Laid-Open No. 2001-30508 is not applicable to the serial inkjet recording apparatus provided with a plurality of recording heads. It is therefore concerned that the recording medium is contaminated by the scattered ink during the wiping operation of the ink adhering to the recording heads.

SUMMARY OF THE INVENTION

The present invention provides a serial inkjet recording apparatus equipped with a plurality of recording heads with reduced amount of scattering of ink toward a recording medium during a wiping operation of the recording heads.

The present invention also provides an inkjet recording device which includes: a carriage which is moved, between a recording area and a non-recording area, in a main scanning direction which intersects with a conveyance direction in which a recording medium is conveyed; a plurality of recording heads mounted on the carriage, the plurality of recording heads including a first recording head situated further away from the recording area when the carriage is in the non-recording area, a second recording head situated closer to the recording area, and a downstream end of the second recording head in the conveyance direction is situated in downstream of a downstream end of the first recording head in the conveyance direction; a first cleaning unit which removes ink adhering to the first recording head by moving in the conveyance direction; and a second cleaning unit which removes ink adhering to the second recording head by moving in the conveyance direction.

Further features according to the present invention will become apparent from the following description of exemplary embodiments with reference to the attached drawings.

DESCRIPTION OF THE EMBODIMENTS

First Embodiment

Figure 1:
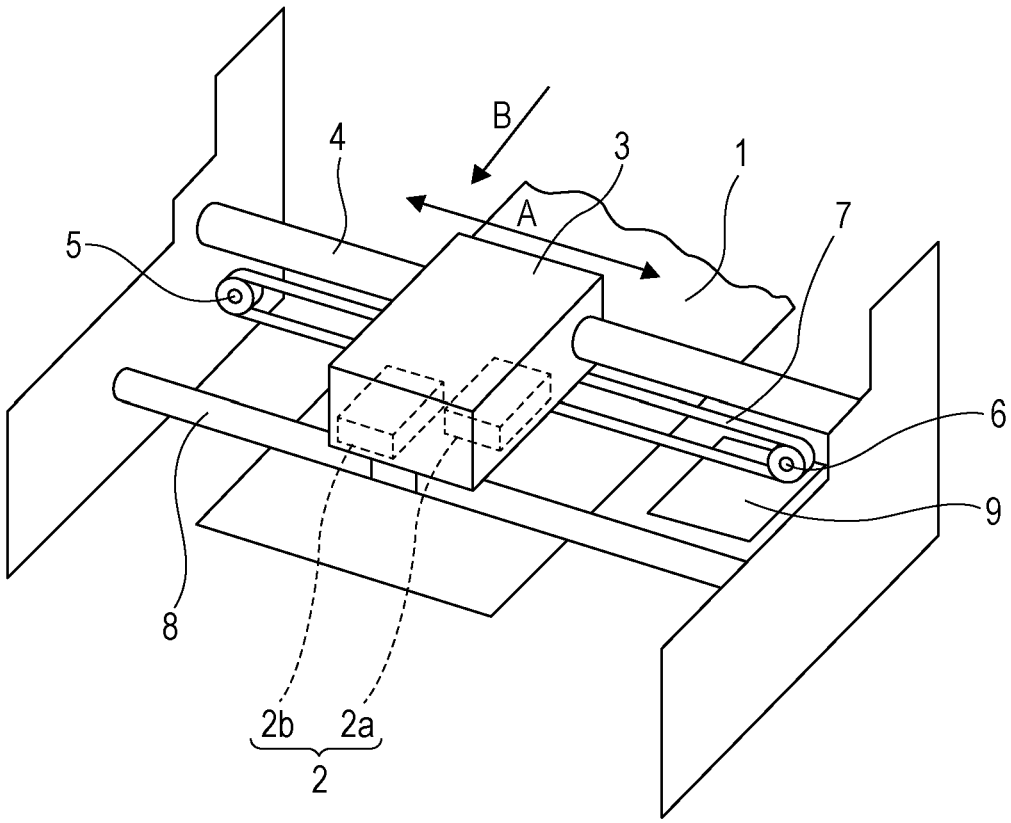
FIG. 1 is an exterior perspective view illustrating a configuration of a main part of an inkjet recording apparatus according to a first embodiment.

Hereinafter, an inkjet recording apparatus of a first embodiment will be described in detail. FIG. 1 is an exterior perspective view illustrating a configuration of a main part of the inkjet recording apparatus of the first embodiment.

In the inkjet recording apparatus illustrated in FIG. 1, a plurality of recording heads 2 are mounted on a bottom surface of a carriage 3. In the present embodiment, the plurality of recording heads 2 are constituted by two recording heads 2*a* and 2*b*. The carriage 3 is supported pivotally and slidably on a guide shaft 4. A carriage motor 5 with a pulley is provided at one end of a range of movement of the carriage 3. An idle pulley 6 is provided at the other end of the range of movement of the carriage 3. A timing belt 7, stretched between the carriage motor 5 and the idle pulley 6, is coupled to the carriage 3. A support member 8 extending in parallel with the guide shaft 4 is provided to prevent rotation of the carriage 3 about the guide shaft 4. The carriage 3 is supported slidably also by the support member 8.

With this configuration, the carriage 3 reciprocates in a main scanning direction (i.e., the direction of arrow A) which intersects with a conveyance direction (i.e., the direction of arrow B) above a recording area (i.e., a printing area) in which a recording medium 1 is conveyed in the conveyance direction. A maintenance mechanism 9 which does maintenance of the recording heads 2 is provided in a non-recording area (i.e., a non-printing area) which is adjacent to one of the ends of the recording area in the main scanning direction. The carriage 3 reciprocates above the recording area and then moves to a position above the non-recording area.

Figure 2A:
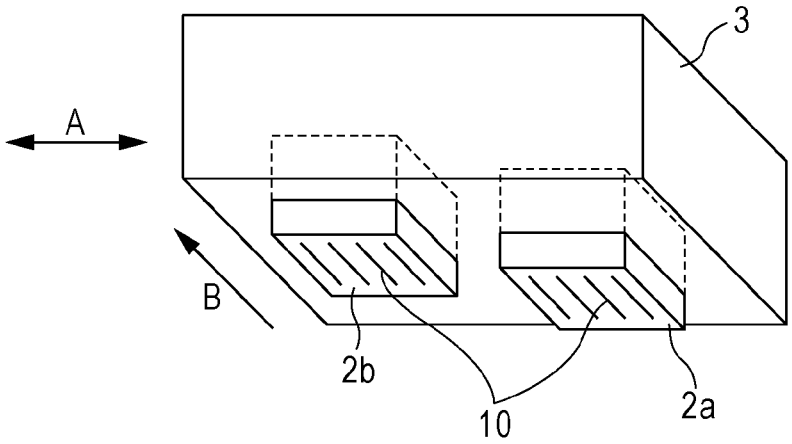
FIGS. 2A and 2B illustrate a configuration of a main part of a recording head mounted on the inkjet recording apparatus illustrated in FIG. 1.
Figure 2B:
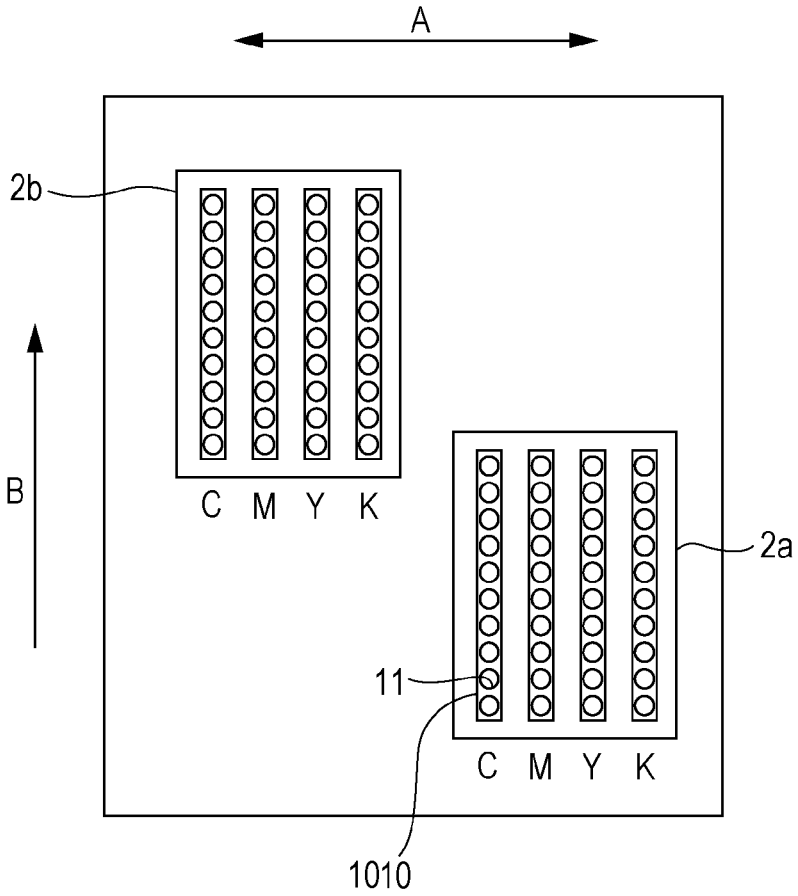

FIGS. 2A and 2B illustrate a configuration of a main part of the recording heads mounted on the inkjet recording apparatus illustrated in FIG. 1. FIG. 2A is an exterior perspective view and FIG. 2B is a plan view of recording heads seen from the side of a nozzle surface (i.e., the side of the bottom surface).

The recording heads 2*a* and 2*b* are arranged on the bottom surface of the carriage 3 such that leading ends thereof in the conveyance direction (i.e., the direction of arrow B) are out of alignment with each other in both the conveyance direction and the main scanning direction (i.e., the direction of arrow A). In the present embodiment, the bottom surface of the carriage 3 is situated higher than the nozzle surfaces of the recording heads 2*a* and 2*b* in order to prevent contact between cleaning units 91*a* and 91*b* of the maintenance mechanism 9, which will be described later, and the carriage 3 while the recording heads 2*a* and 2*b* are cleaned (see FIG. 2A).

Each of the recording heads 2*a* and 2*b* is provided with four nozzle blocks 10 each corresponding to the color of cyan, magenta, yellow and black (CMYK). Each of the nozzle blocks 10 is constituted by a plurality of nozzles 11. In the present embodiment, the recording heads 2*a* and 2*b* are staggered against each other as illustrated in FIG. 2B in order to prevent the distance between the recording heads 2*a* and 2*b* in the conveyance direction from becoming greater. In the present embodiment, the recording head 2*b* which is closest to the recording area in the non-recording area (a leading recording head) is situated further forward than (i.e., in the downstream of) the recording head 2*a* (another recording head) in the conveyance direction.

Figure 3A:
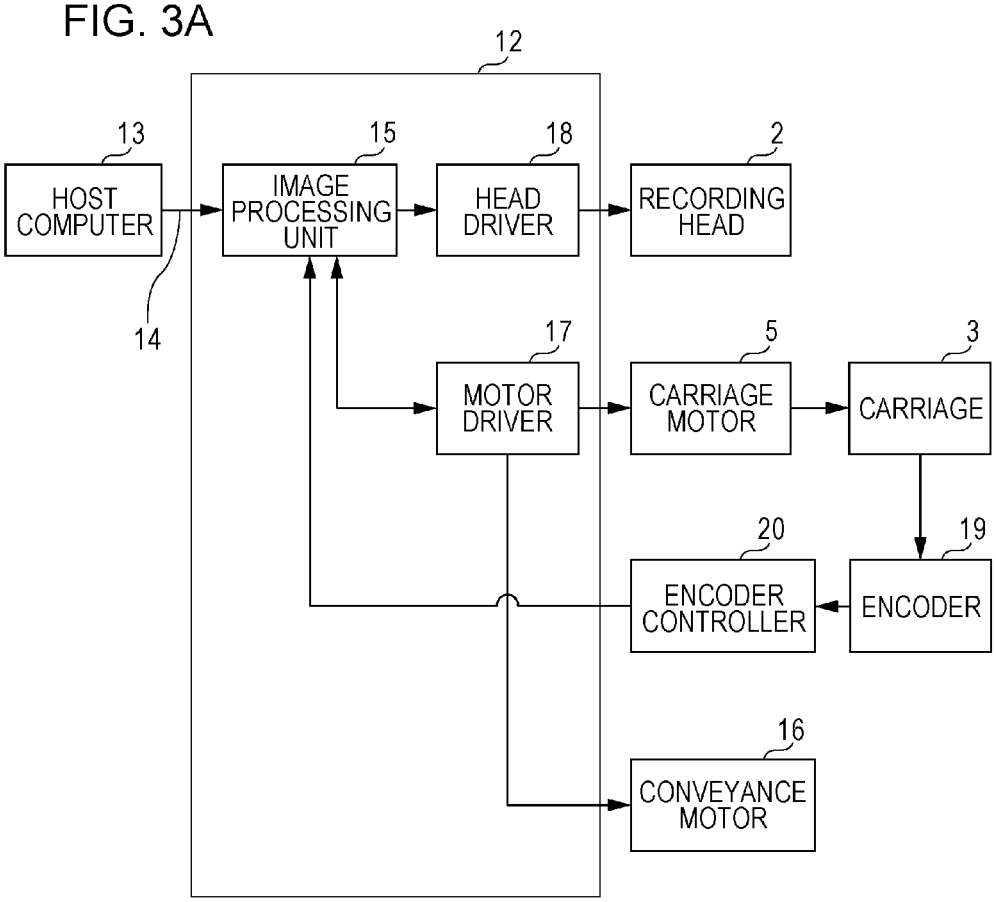
FIGS. 3A and 3B are block diagrams illustrating a control configuration of the inkjet recording apparatus illustrated in FIG. 1.
Figure 3B:
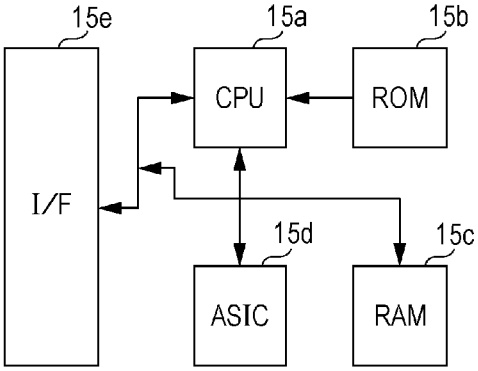

FIGS. 3A and 3B are block diagrams illustrating a control configuration of the inkjet recording apparatus illustrated in FIG. 1. As illustrated in FIG. 3A, the inkjet recording apparatus illustrated in FIG. 1 includes a control unit 12 which controls the entire apparatus. The control unit 12 is connected to a host computer 13 via a cable 14. The control unit 12 controls the operation of the recording heads 2 and the carriage motor 5. The connection may be established with an interface using infrared light (for example, Infrared Data Association (IrDA)) and radio wave (for example, Bluetooth (registered trademark)) instead of the cable 14. The host computer 13 transmits recorded data, kind of modes related to the recording, various commands, and other data to the control unit 12 via the cable 14. The control unit 12 includes an image processing unit 15. FIG. 3B is a block diagram illustrating a configuration of the image processing unit 15. The image processing unit 15 includes a central processing unit (CPU) 15*a*, read only memory (ROM) 15*b*, random access memory (RAM) 15*c*, an application-specific integrated circuit (ASIC) 15*d* and an interface (I/F) 15*e*. The CPU 15*a* performs various processing to control the entire apparatus. A control program corresponding to the various processing the CPU 15*a* performs is stored in the ROM 15*b*. The RAM 15*c* is used as a print buffer or as a workspace in which the control program is performed. The ASIC 15*d* performs various image processing including the raster-column conversion. The I/F 15*e* transmits or receives data to or from the host computer 13.

The control unit 12 includes, in addition to the image processing unit 15, a motor driver 17 which controls the carriage motor 5 and the conveyance motor 16, and a head driver 18 which performs drive control of the recording heads 2. The carriage motor 5 generates driving force to let the carriage 3 reciprocate in the main scanning direction. The conveyance motor 16 drives a feed roller (not illustrated) and a paper ejecting roller (not illustrated) to generate driving force with which the recording medium 1 is conveyed. A position of the carriage 3 in the main scanning direction is detected by an encoder 19, which outputs signals to be fed back to the CPU 15*a* in the image processing unit 15 via an encoder controller 20. The encoder controller 20 processes the signals output from the encoder 19 and generates position signals representing the position of the carriage 3 and speed signals representing the speed of the carriage 3. Therefore, carriage position signals and carriage speed signals are transferred to the CPU 15*a*.

Next, a configuration of the maintenance mechanism 9 will be described.

Figure 4A:
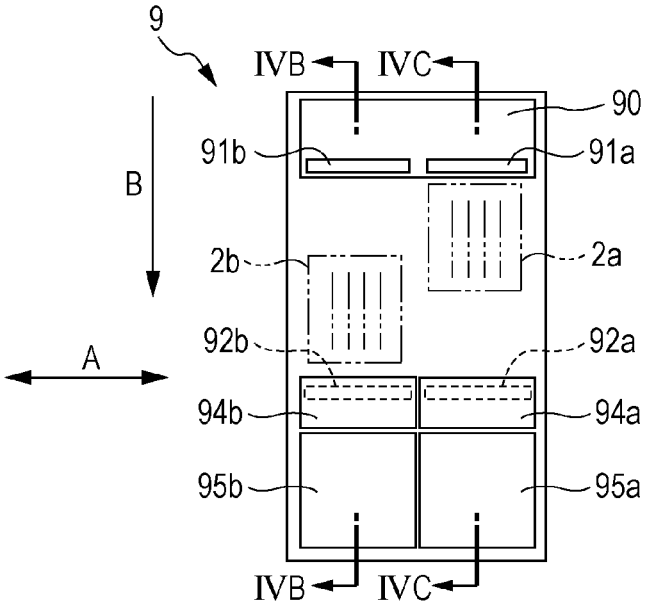
FIGS. 4A to 4C illustrate a configuration of a maintenance mechanism according to the first embodiment of the present invention.
Figure 4B:
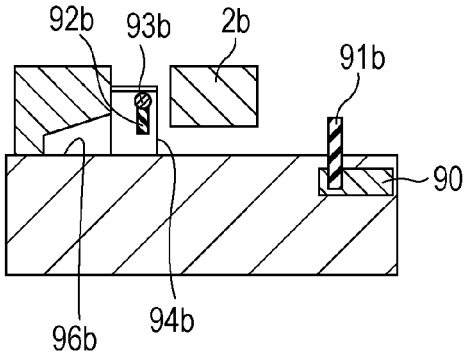
Figure 4C:
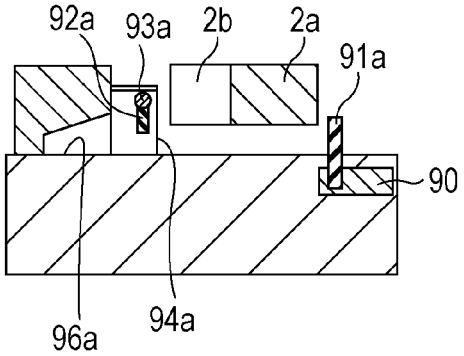

FIGS. 4A to 4C illustrate the configuration of the maintenance mechanism 9 mounted on the inkjet recording apparatus illustrated in FIG. 1. FIG. 4A is a top view; FIG. 4B is a sectional view taken along line IVB-IVB of FIG. 4A; and FIG. 4C is a sectional view taken along line IVC-IVC of FIG. 4A. FIGS. 4A to 4C illustrate a state in which the recording heads 2*a* and 2*b* represented by the two-dot chain lines have moved to positions above the non-recording area.

The maintenance mechanism 9 illustrated in FIG. 4 includes the cleaning units 91*a* and 91*b* which independently wipe the ink adhering to the nozzle surfaces of the recording heads 2*a* and 2*b*. In the present embodiment, the cleaning units 91*a* and 91*b* are wiper blades made of an elastic member, such as rubber and elastomer. The cleaning units 91*a* and 91*b* are attached to a holder 90. The holder 90 moves in the conveyance direction (i.e., the direction of arrow B) in which the recording medium 1 is conveyed. The maintenance mechanism 9 further includes blade cleaners 92*a* and 92*b* which independently remove the ink adhering to the cleaning units 91*a* and 91*b*. The blade cleaners 92*a* and 92*b* are supported pivotally by the shafts 93*a* and 93*b*, respectively. During the wiping operation, the blade cleaners 92*a* and 92*b* stop pivoting and remove the ink adhering to the cleaning units 91*a* and 91*b*. During the returning operation, the blade cleaners 92*a* and 92*b* are pivotable and prevent scattering of the ink. The blade cleaners 92*a* and 92*b* are housed in covers 94*a* and 94*b*, respectively, which prevent scattering of the wiped ink. Wet liquid feeding devices 95*a* and 95*b*, provided adjacent to the covers 94*a* and 94*b*, respectively, apply a cleaning aid liquid (hereinafter, referred to as a wet liquid) to the cleaning units 91*a* and 91*b* in order to facilitate the wiping of thickened ink. A driving transmission device of the maintenance mechanism 9 and a cap mechanism which protects the nozzle surfaces of the recording heads 2*a* and 2*b* during non-printing periods are not illustrated.

Next, a wiping operation by the maintenance mechanism 9 will be described with reference to FIGS. 5A to 5H. FIGS. 5A to 5H are sectional views illustrating the wiping operation according to the present embodiment. FIGS. 5A to 5D are sectional views taken along line IVB-IVB of FIG. 4A. FIGS. 5E to 5H are sectional views taken along line IVC-IVC of FIG. 4A.

Figure 5A:
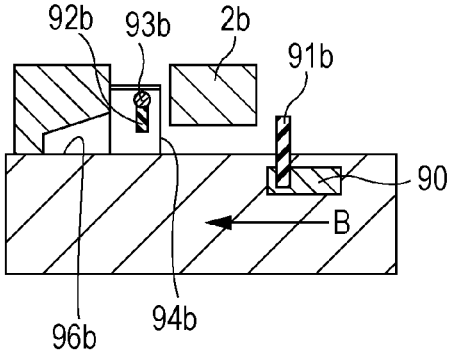
FIGS. 5A to 5H are sectional views illustrating a wiping operation according to the first embodiment of the present invention.

After the recording heads 2*a* and 2*b* eject the ink on the recording medium 1 from the nozzles 11 during reciprocation of the carriage 3, the carriage 3 moves to the position above the non-recording area (i.e., the maintenance mechanism 9) in order to wipe the ink adhering to the nozzle surfaces of the recording heads 2*a* and 2*b*. After the carriage 3 is moved, the holder 90 is moved in the conveyance direction. Accompanying the movement of the holder 90, as illustrated in FIG. 5E, the first cleaning unit 91*a* comes in contact with the first recording head 2*a* and deforms to thereby wipe the ink adhering to the nozzle surface of the first recording head 2*a*. At this time, the second cleaning unit 91*b* is not in contact with the second recording head 2*b* as illustrated in FIG. 5A.

Figure 5B:
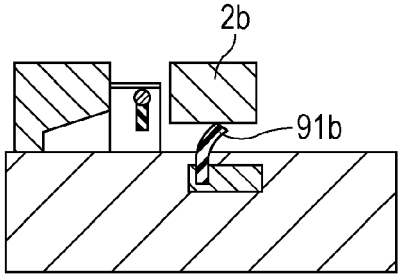

When the holder 90 is moved further, as illustrated in FIG. 5B, the second cleaning unit 91*b* comes in contact with the second recording head 2*b* and deforms to thereby wipe the ink adhering to the nozzle surface of the second recording head 2*b*. At this time, as illustrated in FIG. 5F, the first cleaning unit 91*a* moves away from the first recording head 2*a* and returns in a single motion to its pre-deformed shape. Here, it is concerned that the wiped ink partially scatters toward the recording medium 1 in reaction to the motion of the first cleaning unit 91*a* and thereby the recording medium 1 is contaminated. In the present embodiment, however, since the second recording head 2*b* is situated diagonally to the front of the first recording head 2*a* in the moving direction of the holder (see FIG. 5F), the second recording head 2*b* prevents scattering of the ink toward the recording medium 1.

Figure 5C:
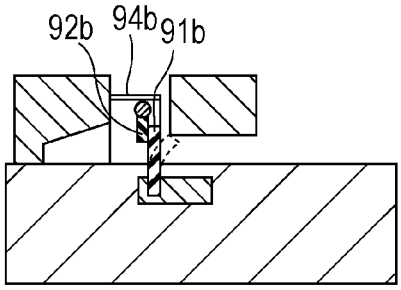
Figure 5D:
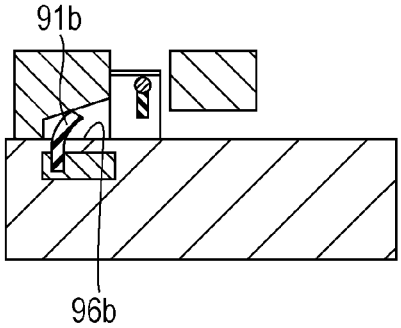
Figure 5E:
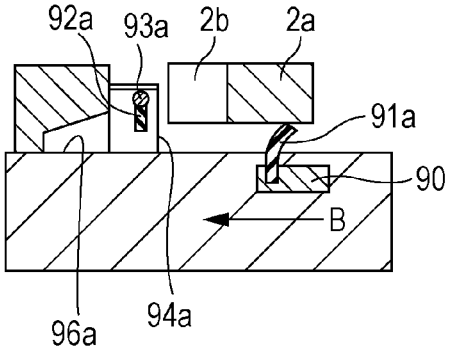
Figure 5F:
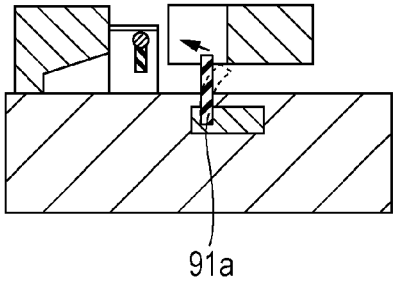
Figure 5G:
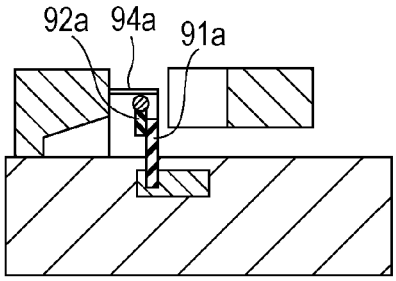

If the holder 90 is moved further, as illustrated in FIG. 5C, the second cleaning unit 91*b* moves away from the second recording head 2*b* and returns to its pre-deformed state in a single motion. Here, it is concerned that the wiped ink partially scatters toward the recording medium 1 in reaction to the motion of the second cleaning unit 91*b* and thereby the recording medium 1 is contaminated. In the present embodiment, however, since the second blade cleaner 92*b* is provided near the second recording head 2*b*, the second cleaning unit 91*b* abuts the second blade cleaner 92*b* which stops the movement of the second cleaning unit 91*b*. Thus scattering of the ink is reduced. The second cover 94*b* is provided to surround the second blade cleaner 92*b*. The second cover 94*b* prevents scattering of the ink toward the recording medium 1. The first cleaning unit 91*a* is housed in the first cover 94*a* as illustrated in FIG. 5G. In the present embodiment, the blade cleaners 92*a* and 92*b* are situated higher than the nozzle surfaces of the recording heads 2*a* and 2*b* in order that the blade cleaners 92*a* and 92*b* receive the tips of the cleaning units 91*a* and 91*b* which have returned their pre-deformed shapes so as to prevent scattering of the ink. Also, the covers 94*a* and 94*b* are situated higher than the nozzle surfaces of the recording heads 2*a* and 2*b* in order to cover the blade cleaners 92*a* and 92*b*. The second blade cleaner 92*b* and the second cover 94*b* may be situated adjacent to the tip of the second recording head 2*b* in order to prevent scattering of the ink toward the recording medium 1 without interfering with the movement of the second recording head 2*b* in the main scanning direction.

Figure 5H:
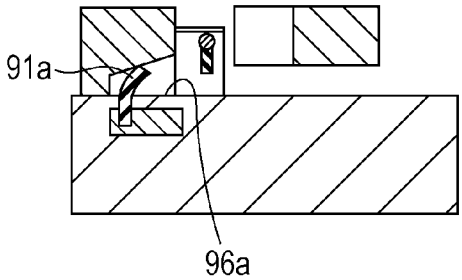

The cleaning units 91*a* and 91*b* pass over, undergoing deformation, the blade cleaners 92*a* and 92*b*. In this process, the ink adhering to the cleaning units 91*a* and 91*b* is removed and the cleaning units 91*a* and 91*b* return to be the clean state. Finally, the first cleaning unit 91*a* comes in contact with a first wet liquid feeding unit 96*a* of the first wet liquid feeding device 95*a* as illustrated in FIG. 5H. At the same time, the second cleaning unit 91*b* comes in contact with a second wet liquid feeding unit 96*b* of the second wet liquid feeding device 95*b* as illustrated in FIG. 5D. When the cleaning units 91*a* and 91*b* come into contact with the wet liquid feeding devices 95*a* and 95*b*, the wet liquid transfers to the tip of the first cleaning unit 91*a* and the tip of the second cleaning unit 91*b*. Thus, the wiping operation is completed. Upon completion of the wiping operation, the carriage 3 retracts from the position above the maintenance mechanism 9. After that, the cleaning units 91*a* and 91*b* return to the initial position illustrated in FIG. 4A accompanying the movement of the holder 90.

According to the present embodiment, the ink adhering to the recording heads 2*a* and 2*b* is wiped in a manner that the first cleaning unit 91*a* first wipes the first recording head 2*a* in the non-recording area, situated distant from the recording area. After the wiping, even if the ink scatters toward the recording medium 1 when the first cleaning unit 91*a* returns to its pre-deformed shape, the second recording head 2*b* situated diagonally to the front of the first recording head 2*a* prevents that scattering of the ink toward the recording medium 1. Even if the ink scatters toward the recording medium 1 when the second cleaning unit 91*b* which wiped the ink adhering to the second recording head 2*b* returns to its pre-deformed shape, the second cover 94*b* prevents scattering of the ink toward the recording medium 1. Therefore, the recording medium 1 is not easily contaminated during the wiping operation of the ink adhering to the recording heads 2*a* and 2*b*. This configuration prevents the image quality from being impaired.

A configuration in which the first cleaning unit 91*a* and the second cleaning unit 91*b* are moved in the conveyance direction of the recording medium has been described above: but the direction in which the first cleaning unit 91*a* and the second cleaning unit 91*b* are moved is not limited to the conveyance direction of the recording medium. Any direction that intersects the main scanning direction in which the carriage is moved is selectable. That is, the first cleaning unit 91*a* and the second cleaning unit 91*b* may be moved in the direction opposite to the conveyance direction of the recording medium. Alternatively, the first cleaning unit 91*a* and the second cleaning unit 91*b* may be moved in a diagonal direction which intersects the main scanning direction. In that case, when the carriage is in the non-recording area, the first recording head is situated farther away from the recording area and the second recording head is situated closer to the recording area. The downstream end of the second recording head in the moving direction of the cleaning unit is situated in the downstream of the downstream end of the first recording head in the moving direction of the cleaning unit.

Second Embodiment

Figure 6A:
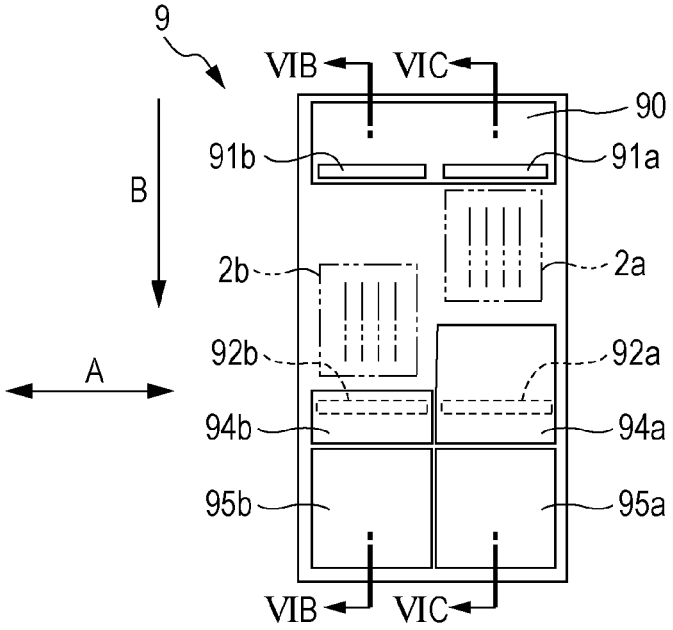
FIGS. 6A to 6C illustrate a configuration of a maintenance mechanism according to a second embodiment of the present invention.
Figure 6B:
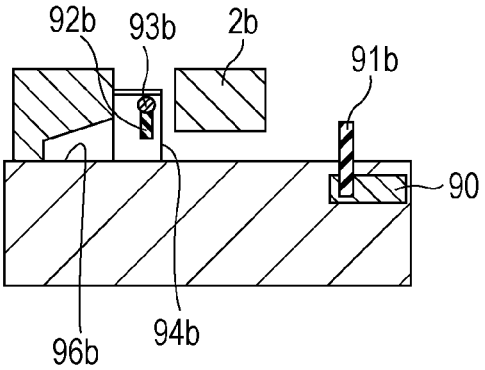
Figure 6C:
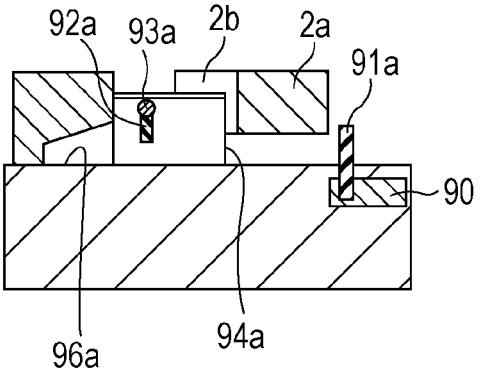

Hereinafter, an inkjet recording apparatus of a second embodiment will be described. The inkjet recording apparatus according to the present embodiment is the same as that according to the first embodiment except for the configuration of the maintenance mechanism 9. FIGS. 6A to 6C illustrate a configuration of the maintenance mechanism 9 mounted on the inkjet recording apparatus according to the present embodiment. FIG. 6A is a top view; FIG. 6B is a sectional view taken along line VIB-VIB of FIG. 6A; and FIG. 6C is a sectional view taken along line VIC-VIC of FIG. 6A. FIGS. 6A to 6C illustrate a state in which the recording heads 2*a* and 2*b* represented by the two-dot chain lines have moved to positions above the non-recording area accompanying the movement of the carriage 3. Components similar to those described in the first embodiment will be denoted by similar reference numerals and description thereof will be omitted.

In the present embodiment, the maintenance mechanism 9 includes a holder 90, cleaning units 91*a* and 91*b*, blade cleaners 92*a* and 92*b* and covers 94*a* and 94*b* as illustrated in FIG. 6A. In the present embodiment, however, the first cover 94*a* is provided close to a tip of a first recording head 2*a*. In this case, as illustrated in FIG. 6C, it is concerned that, when the carriage 3 is moved to a position above the non-recording area (i.e., above the maintenance mechanism 9), the second recording head 2*b* comes in contact with the first cover 94*a*. However, as illustrated in FIG. 6A, the carriage 3 stops at a position at which the second recording head 2*b* does not come in contact with the first cover 94*a*. Accordingly, the second recording head 2*b* does not come into contact with the first blade cleaner 92*a* and the first cover 94*a*.

Next, a wiping operation by the maintenance mechanism 9 according to the present embodiment will be described with reference to FIGS. 7A to 7H. FIGS. 7A to 7H are sectional views illustrating the wiping operation according to the present embodiment. FIGS. 7A to 7D are sectional views taken along line VIB-VIB of FIG. 6A. FIGS. 7E to 7H are sectional views taken along line VIC-VIC of FIG. 6A.

Figure 7A:
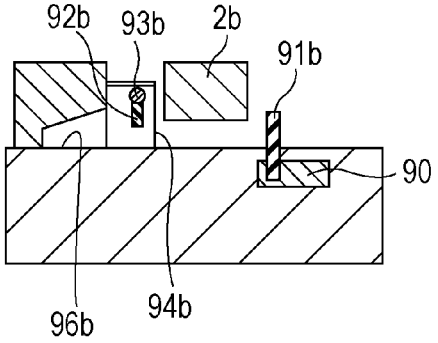
FIGS. 7A to 7H are sectional views illustrating a wiping operation according to the second embodiment of the present invention.

In the present embodiment, as in the first embodiment, after the carriage 3 is moved to a position above the non-recording area (i.e., above the maintenance mechanism 9), the holder 90 is moved in the conveyance direction (see arrow B) in which the recording medium 1 is conveyed. Accompanying the movement of the holder 90, as illustrated in FIG. 7E, the first cleaning unit 91*a* comes in contact with the first recording head 2*a* and deforms to thereby wipe the ink adhering to the nozzle surface of the first recording head 2*a*. At this time, the second cleaning unit 91*b* is not in contact with the second recording head 2*b* as illustrated in FIG. 7A.

Figure 7B:
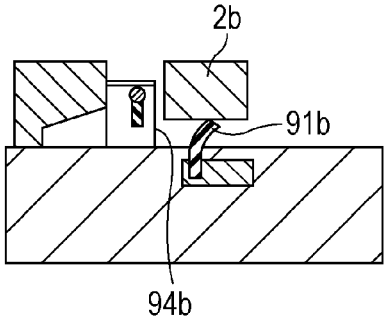

When the holder 90 is moved further, as illustrated in FIG. 7B, the second cleaning unit 91*b* comes in contact with the second recording head 2*b* and deforms to thereby wipe the ink adhering to the nozzle surface of the second recording head 2*b*. At this time, as illustrated in FIG. 7F, the first cleaning unit 91*a* moves away from the first recording head 2*a* and returns in a single motion to its pre-deformed shape. Here, as in the first embodiment, it is concerned that the ink scatters in reaction to the motion of the first cleaning unit 91*a* and the recording medium 1 is contaminated. In the present embodiment, however, since the first cover 94*a* is provided near the first recording head 2*a*, the first cover 94*a* prevents scattering of the ink toward the recording medium 1.

Figure 7C:
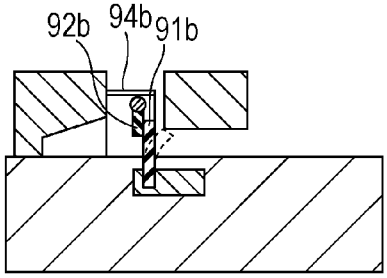

If the holder 90 is moved further, as illustrated in FIG. 7C, the second cleaning unit 91*b* moves away from the second recording head 2*b* and returns to its pre-deformed shape in a single motion. Here, since the second blade cleaner 92*b* is provided near the second recording head 2*b*, the second cleaning unit 91*b* abuts the second blade cleaner 92*b* which stops the movement of the second cleaning unit 91*b*. Thus scattering of the ink is reduced. The second cover 94*b* is provided to surround the second blade cleaner 92*b*. The second cover 94*b* prevents scattering of the ink toward the recording medium 1.

Figure 7D:
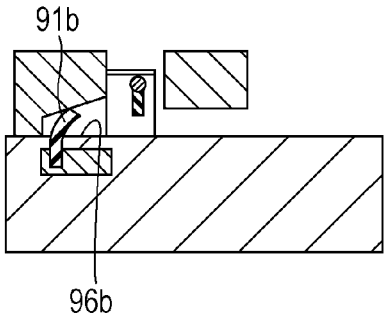
Figure 7E:
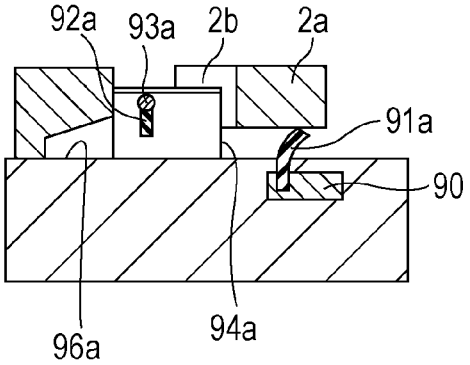
Figure 7F:
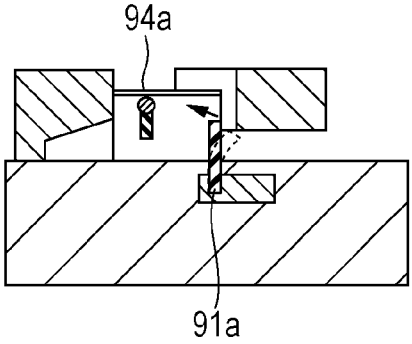
Figure 7G:
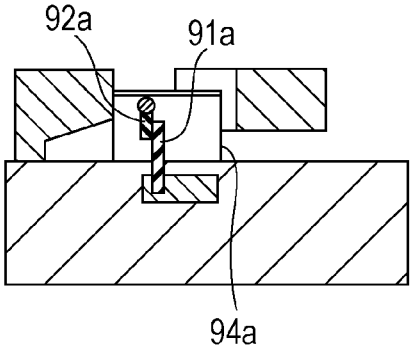
Figure 7H:
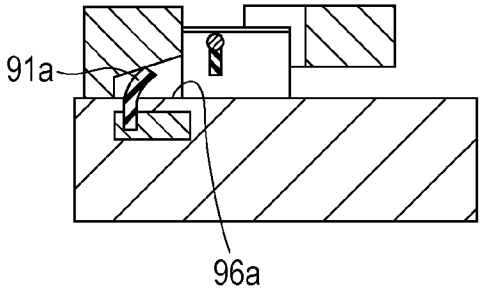

The cleaning units 91*a* and 91*b* pass over, undergoing deformation, the blade cleaners 92*a* and 92*b*. In this process, the ink adhering to the cleaning units 91*a* and 91*b* is removed and the cleaning units 91*a* and 91*b* return to be the clean state. Finally, the first cleaning unit 91*a* comes in contact with a first wet liquid feeding unit 96*a* of a first wet liquid feeding device 95*a* as illustrated in FIG. 7H. At the same time, the second cleaning unit 91*b* comes in contact with a second wet liquid feeding unit 96*b* of a second wet liquid feeding device 95*b* as illustrated in FIG. 7D. When the cleaning units 91*a* and 91*b* come into contact with the wet liquid feeding devices 95*a* and 95*b*, the wet liquid transfers to the tip of the first cleaning unit 91*a* and the tip of the second cleaning unit 91*b*. Thus, the wiping operation is completed. Upon completion of the wiping operation, the carriage 3 retracts from the position above the maintenance mechanism 9. After that, the cleaning units 91*a* and 91*b* return to the initial position illustrated in FIG. 6A accompanying the movement of the holder 90.

According to the present embodiment, as in the first embodiment, the ink adhering to the recording heads 2*a* and 2*b* is wiped in a manner that the first cleaning unit 91*a* first wipes the first recording head 2*a* in the non-recording area, situated distant from the recording area. After the wiping, even if the ink scatters toward the recording medium 1 when the first cleaning unit 91*a* returns to its pre-deformed state, the first cover 94*a* prevents scattering of the toward the recording medium 1. Even if the ink scatters toward the recording medium 1 when the second cleaning unit 91*b* which comes in contact with the second recording head 2*b* returns to its pre-deformed state, the second cover 94*b* prevents scattering of the ink toward the recording medium 1 as in the first embodiment. Therefore, the recording medium 1 is not easily contaminated during the wiping operation of the ink adhering to the recording heads 2*a* and 2*b*. In the present embodiment, it is also possible to prevent the second recording head 2*b* from being contaminated by the ink scattering from the first cleaning unit 91*a*. With this configuration, an inside of the apparatus is not easily contaminated during the cleaning of the recording heads 2*a* and 2*b*. According to each of the embodiments of the present invention, even if the ink scatters toward the recording medium when the cleaning unit returns to its pre-deformed shape, another recording head situated further toward the recording medium prevents scattering of the ink toward the recording medium. Even if the ink scatters toward the recording medium when the first cleaning unit which comes in contact with the first recording head returns to its pre-deformed shape, the cover prevents scattering of the ink toward the recording medium. Therefore, the recording medium is not easily contaminated during the wiping operation of the ink adhering to a plurality of recording heads.

Similarly, in the second embodiment, the direction in which the first cleaning unit 91*a* and the second cleaning unit 91*b* are moved is not limited to the conveyance direction of the recording medium; any direction which intersects the main scanning direction in which the carriage is moved is selectable. That is, the first cleaning unit 91*a* and the second cleaning unit 91*b* may be moved in the direction opposite to the conveyance direction of the recording medium. Alternatively, the first cleaning unit 91*a* and the second cleaning unit 91*b* may be moved in a diagonal direction which intersects the main scanning direction. In that case, when the carriage is in the non-recording area, the first recording head is situated farther away from the recording area and the second recording head is situated closer to the recording area. The downstream end of the second recording head in the moving direction of the cleaning unit is situated in the downstream of the downstream end of the first recording head in the moving direction of the cleaning unit.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-193584 filed Aug. 31, 2010, which is hereby incorporated by reference herein in its entirety.

What is claimed is:

1. An inkjet recording apparatus comprising:

a first recording head having a first nozzle surface configured to eject ink to a recording medium;

a second recording head having a second nozzle surface configured to eject ink to a recording medium;

a carriage configured to move with the first recording head and the second recording head mounted thereon between a recording area and a non-recording area in a carriage moving direction;

a first wiper configured to wipe the first nozzle surface;

a second wiper configured to wipe the second nozzle surface;

a wiper holder which includes the first wiper and the second wiper and is moved in a wiping direction intersecting the carriage moving direction, wherein the second recording head is situated closer to the recording area than the first recording head in the carriage moving direction and is situated at a downstream side of the first recording head in the wiping direction, in a case where the carriage is moved to the non-recording area;

a first cover being arranged at a downstream side of the first recording head in the wiping direction to prevent scattering of ink from the first wiper wiping the first nozzle surface, wherein the first cover arranged overlapped with the second nozzle surface in the wiping direction; and a second cover being arranged at a downstream side of the second recording head in the wiping direction to prevent scattering of the ink from the second wiper wiping the second nozzle surface.

2. An inkjet recording apparatus according to claim 1, further comprising a first cleaner which removes ink adhering to the first wiper, wherein the first cleaner is arranged in the first cover; and a second cleaner which removes ink adhering to the second wiper, wherein the second wiper is arranged in the second wiper.

3. An inkjet recording apparatus according to claim 1, further comprising a feeding unit which feeds a wet liquid to the first wiper and the second wiper.

* * * * *